US006131596A

United States Patent [19]

Monson

[11] Patent Number: 6,131,596

[45] Date of Patent: Oct. 17, 2000

[54] AUTOMATIC VACUUM ISOLATION VALVE NETWORK FOR A VACUUM COLLECTION SYSTEM

[75] Inventor: Timothy W. Monson, Poplar Grove, Ill.

[73] Assignee: Evac International Oy, Helsinki, Finland

[21] Appl. No.: 09/350,584

[22] Filed: Jul. 9, 1999

[51] Int. Cl.[7] ..... F04F 3/00

[52] U.S. Cl. ..... 137/14; 137/111; 137/205

[58] Field of Search ..... 137/14, 111, 205

[56] References Cited

U.S. PATENT DOCUMENTS

| | | | |
|---|---|---|---|
| 3,686,693 | 8/1972 | Liljendahl | 137/205 X |
| 3,746,032 | 7/1973 | Wallgren | 137/205 |
| 5,937,888 | 8/1999 | McKiernan et al. | 137/205 |

*Primary Examiner*—Gerald A. Michalsky

*Attorney, Agent, or Firm*—Marshall, O'Toole, Gerstein, Murray & Borun

[57] ABSTRACT

An automatic vacuum isolation valve network for use in a vacuum collection system having at least two branches connected to a main vacuum pipe maintained under negative pressure. The network includes a first valve located in each branch adapted to close in response to vacuum loss in the main vacuum pipe, thereby preserving a vacuum level in the associated branch. The network further includes a shut-off valve located in each branch upstream of the first valve, the shut-off valve adapted to close in response to vacuum loss in an upstream portion of a branch. The shut-off valve thereby isolates a broken branch, and allows a remainder of the vacuum collection system to return to normal operation. The isolation valve network further facilitates location of a breach in the vacuum collection system by rendering a faulty branch inoperable, thereby identifying the immediate vicinity of the breach.

20 Claims, 2 Drawing Sheets

AUTOMATIC VACUUM ISOLATION VALVE NETWORK FOR A VACUUM COLLECTION SYSTEM

FIELD OF THE INVENTION

The present invention generally relates to liquid collecting apparatus, and more particularly to vacuum collection systems.

BACKGROUND OF THE INVENTION

Vacuum collection systems have been used in a wide variety of applications to collect and transport waste water. For example, vacuum collection systems are used to collect sewage from bathrooms on airplanes, trains, and ships. The systems are also used in non-sewage applications to collect used or dirty process water, also known as gray water.

Vacuum collection systems are used in place of conventional gravity drainage piping to facilitate installation and pipe layout changes. In a conventional drainage piping system, pipe inlets are located below waste water sources and feed into drainage pipes leading to a sewer line. The piping in such systems must be continuously sloped so that the waste water flows away from the source and into the sewer line under the force of gravity. As a result, pipes for gravity drainage systems are often laid in or underneath a concrete pad supporting the facility. This pipe location not only requires significant amounts of additional plumbing work, but also complicates changes in facility layout, in that portions of the concrete pad must be ripped up to expose the piping.

The vacuum collection systems, however, use suction to collect the waste water, thereby, eliminating the need for downwardly sloped pipes. The vacuum collection systems typically comprise a collection drain located under each waste water source and one or more collection branches leading to a main vacuum pipe. The main vacuum pipe is connected to a pump which creates negative pressure in the main vacuum pipe and branch to thereby pull liquid through the branch and main vacuum pipe and into an attached collection tank.

Significantly, vacuum collection systems allow the use overhead drainage piping since suction, rather than gravity, is used to transport the waste water. The piping in vacuum collection systems does not need to be laid in concrete below the waste water source, but instead may follow overhead electrical and refrigeration service lines. Thus, plumbing layouts are simplified, and waste water generating equipment may be quickly and easily relocated within a facility without ripping up concrete.

While the use of a vacuum collection systems allows greater freedom in routing drainage piping, the entire system may be rendered inoperable due to a loss of vacuum in a single branch. For example, a crack may develop in a collection line connected to the branch or a control valve associated with a collection line may be remain open due to a faulty activator. In either case, the entire systems is susceptible to a loss in vacuum which prevents the system from collecting waste water. Consequently, additional waste water may back up and spill onto the floor of the facility in which the vacuum collection system is installed.

Furthermore, locating the breach in the system is overly difficult and time consuming. Up to now, the easiest and most common method for detecting a breach in a vacuum collection system is to listen for air flow through the breach. The vacuum in a faulty branch, however, is very low, making audible detection of a leak exceedingly difficult. As a result, leak detection often requires each branch in the system to be manually isolated to determine the location of the leak.

SUMMARY OF THE INVENTION

In accordance with certain aspects of the present invention, an automatic vacuum isolation valve network is provided for use in a vacuum collection system having at least two branches connected to a main vacuum pipe in fluid communication with a vacuum source. The network comprises a first valve located in each branch, the first valve adapted to close when air pressure in the main vacuum pipe is greater than air pressure in the branch. The network further comprises a shut-off valve located in each branch upstream of the first valve, the shut-off valve adapted to close in response to vacuum loss in an upstream portion of the branch, thereby isolating the branch.

In accordance with additional aspects of the present invention, a vacuum collection system for evacuating waste water is provided in which the system comprises a vacuum source adapted to generate a vacuum level, a tank having a vacuum intake in fluid communication with the vacuum source and a waste water intake, and a main vacuum pipe connected to the waste water intake. The system further comprises first and second branches, each branch including a first valve located in the collection pipe, the first valve adapted to close when air pressure in the main vacuum pipe is greater than air pressure in the branch, and a shut-off valve located in the branch of the first valve, the shut-off valve adapted to close in response to vacuum loss in a downstream portion of the branch, thereby isolating the branch.

In accordance with still further aspects of the present invention, a method for maintaining vacuum in a vacuum collection system in the event of a breach is provided. The vacuum collection system comprises at least two branches in fluid communication with a main vacuum pipe maintained under vacuum. Each branch includes a first valve and a shut-off valve located downstream of the first valve. The method comprises the steps of closing the first valve of each unbroken branch thereby to maintain vacuum therein, closing the shut-off valve of each faulty branch thereby to isolate the faulty branch from the main vacuum pipe, and opening the first valve of each unbroken branch to reestablish fluid communication with the main vacuum pipe.

Other features and advantages are inherent in the apparatus claimed and disclosed or will become apparent to those skilled in the art from the following detailed description and its accompanying drawings.

DETAILED DESCRIPTION OF THE PREFERRED EMBODIMENTS

Figure 1:
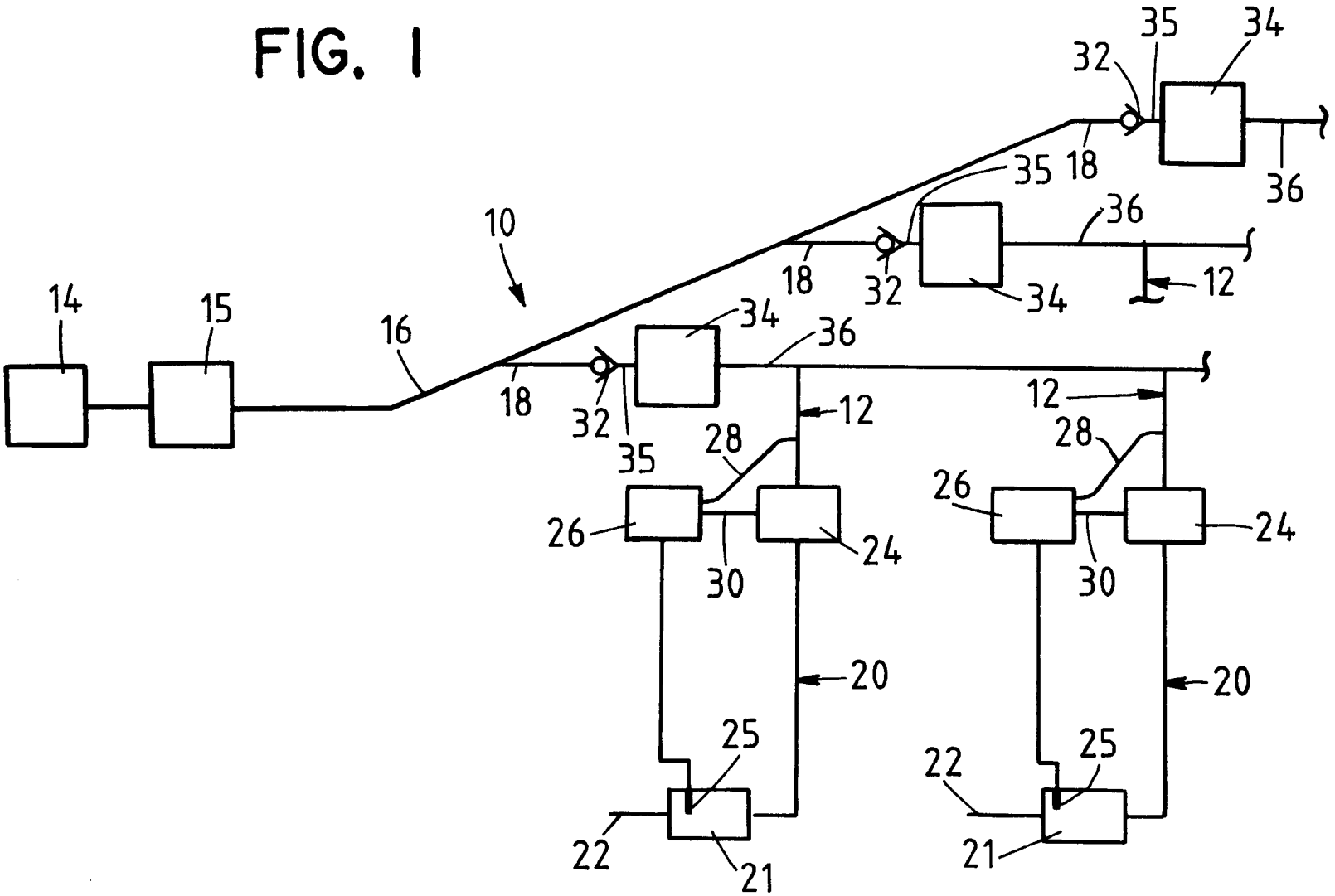
FIG. 1 is a block diagram of a vacuum collection system incorporating an isolation valve network in accordance with the present invention.

A vacuum collection system 10 incorporating an automatic vacuum isolation valve network in accordance with the teachings of the present invention is illustrated in FIG. 1. The illustrated vacuum collection system 10 includes a vacuum source 14, such as a pump, in fluid communication with a main vacuum pipe 16. The main vacuum pipe 16, in turn, is connected to a plurality of branches 18. While the illustrated embodiment shows a system 10 having three branches, the present invention may be used with a system having as few as two to as many as ten or more branches 18. At least one collection line 12 is attached to each branch 18, as illustrated by the lowest branch 18 in FIG. 1. In the illustrated embodiment, each collection line 12 comprises a collection pipe 20 having a first end attached to a branch 18 and a second end defining an inlet 22 for receiving waste water. Each inlet 22 is positioned under a waste water source (not shown). The collection lines 12 illustrated in FIG. 1 are typical for all collection lines in the vacuum collection system 10.

A control valve 24 is disposed in each collection pipe 20 to allow the vacuum collection system 10 to transport liquid up vertical lifts in the pipe 20 (FIG. 1). It will be appreciated that the vacuum source 14 is limited in its ability to continuously pump liquid vertically upward. Accordingly, the vacuum collection system 10 periodically transports discrete volumes of liquid known as "slugs." A buffer area, such as a buffer box 21, is located in the collection pipe 20 to collect fluid in slug volumes. Accordingly, when a sufficient volume of fluid has collected in the buffer box 21, the control valve 24 opens to create negative pressure in the collection pipe 20. As a result, a pressure differential exists across the volume of waste water created by the negative pressure in the collection pipe 20 at one end of the slug and atmospheric pressure at the other end. The pressure differential transports the slug of liquid upward through the collection pipe 20 and the branch 18 to the main vacuum pipe 16. Once in the main vacuum pipe 16, the waste water travels toward the vacuum source 14 and may be collected in a tank 15 located before the vacuum source 14. Each collection line 12 has a similar control valve 24 so that slugs of water are selectively transported through each branch 18 to the main vacuum pipe 16.

To eliminate the need for additional wiring, the control valves 24 are preferably pneumatically operated. As illustrated in FIG. 1, each control valve 24 has an associated activator 26 which controls operation of the valve 24. The activator 26 has a vacuum feed line 28 which taps into the collection pipe 20 and a valve line 30 connected to the control valve 24. The control valve 24 is operable between the open and closed positions using the negative pressure provided in the collection pipe 20 when transported through the vacuum feed and valve lines 28, 30 via the activator 26.

The activator 26 preferably actuates the control valve 24 according to liquid level at the inlet 22. Accordingly, a sensor 25 for detecting liquid level height and generating a positive pressure signal is disposed in the buffer box 21 and connected to the activator 26. Thus, the activator 26 may be set so that, when a particular liquid level height is sensed in the buffer box 21, the activator 26 allows negative pressure to flow to the valve line 30, thereby opening the control valve 24.

The structure described to this point provides the basic components for a vacuum collection system 10 capable of transporting waste water up a vertical lift. The particular system in which the isolation valve network 12 is installed may include additional or different components without departing from the spirit and scope of the present invention.

In accordance with certain aspects of the present invention, each branch 18 further includes a first valve 32 (FIG. 1) for temporarily preserving vacuum in unbroken branches in the event of a breach in the vacuum collection system 10. The first valve 32 is located downstream of the associated control valve 24 and is adapted to automatically close in the event of vacuum loss in the main vacuum pipe 16. It will be appreciated that a breach in one of the branches 18 reduces vacuum level in the entire vacuum collection system 10. Accordingly, loss of vacuum in the main vacuum pipe 16 is indicative of a breach. The first valve 32 is preferably responsive to a pressure differential created across the valve 32, in which a normal vacuum level is present in the branch 18 upstream of the valve while a reduced vacuum level is present downstream of the valve in the main vacuum pipe 16. As a result, the greater pressure present in the main vacuum pipe 16 acts to close the first valve 32, thereby preserving the vacuum level in the upstream branch 18. The first valve 32 is preferably located as close as possible to the main vacuum pipe 16 to maximize the volume of the branch 18 preserved under negative pressure. In the most preferred embodiment, the first valve 32 is a check valve.

Figure 2:
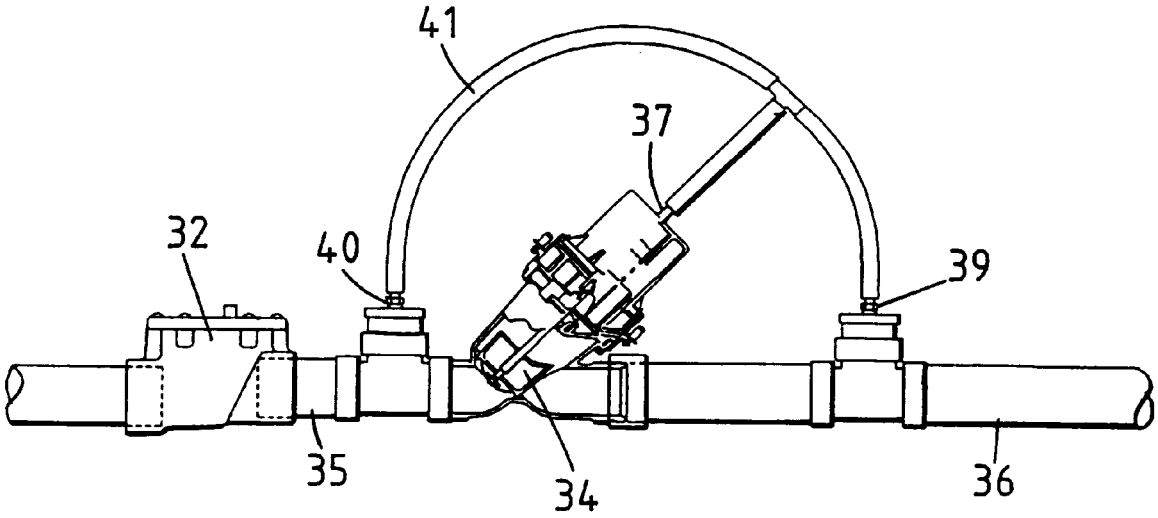
FIG. 2 is an enlarged side view of an isolation valve assembly installed in a branch, in accordance with the present invention.

In accordance with additional aspects of the present invention, each branch 18 further includes a shut-off valve 34 for isolating a faulty branch 18. As schematically illustrated in FIG. 1, the shut-off valve 34 is located between the control valve 24 and the first valve 32 to define intermediate and upstream portions 35, 36 of the branch 18. The shut-off valve 34 is adapted to close in response to vacuum loss in the upstream portion 36 of the collection pipe 20. In a preferred embodiment, each shut-off valve 34 is a vacuum operated, normally closed valve having an operating port 37 in fluid communication with an upstream port 39 disposed in the upstream portion 36 (FIG. 2). Vacuum present in the upstream portion 36 travels through the upstream port 39 to the operating port 37 to actuate the shut-off valve 34 to an open position. In the event of vacuum loss, the valve 34 returns to its normally closed position, thereby isolating the associated branch 18. The shut-off valve 34 is set to close at a trigger pressure, which indicates that a vacuum level in the upstream portion 36 has dropped below a normal operating vacuum level in the system 10. The trigger pressure is preferably set so that the valve 34 does not actuate in response to normal pressure fluctuations experienced during operation of the system 10.

Figure 3:
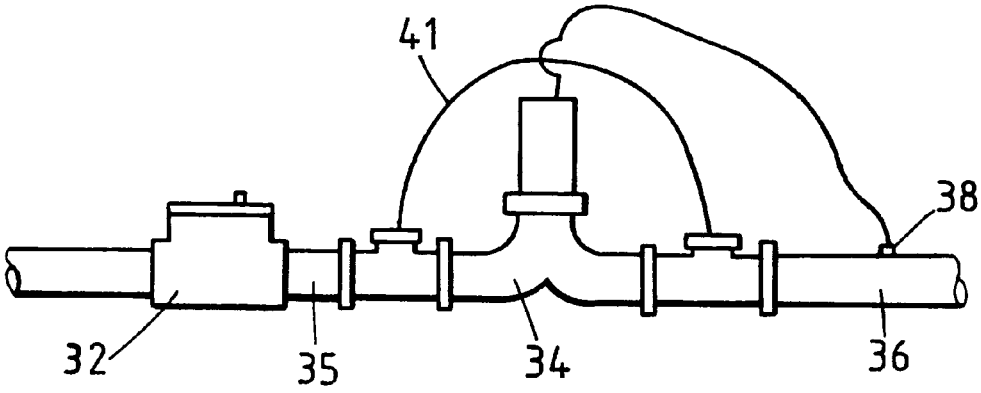
FIG. 3 is an enlarged side view of an alternative embodiment of an isolation valve assembly installed in a branch, in accordance with the present invention.

In an alternative embodiment, the shut-off valve 34 may be electrically operated. In this embodiment, illustrated at FIG. 3, the shut-off valve 34 is normally open and a pressure sensor 38 is located in the upstream portion 36 of the branch 18. The shut-off valve 34 is operatively connected to the pressure sensor 38 to move to a closed position when the pressure sensor detects a pressure above a predetermined vacuum level, thereby isolating the collection pipe 20.

In the preferred embodiment, each branch 18 further comprises a bypass port 40 for returning an isolated branch 18 to normal operation. As best illustrated in FIG. 2, the bypass port 40 is in fluid communication with the upstream port 39. As a result, vacuum present in the downstream portion 35 passes through the bypass port 40 and upstream port 39 to the upstream portion 36 of the branch 18. Accordingly, once the breach in the collection pipe 20 has been fixed, the bypass port 40 allows vacuum to build in the upstream portion 36 of the collection pipe 20 to eventually return the shut-off valve 34 to the open position. In the illustrated embodiment, the bypass port 40 is connected to the upstream port 39 with a bypass line 41 formed of flexible tubing.

In operation, it will be appreciated that the isolation valve network 12 of the present invention automatically isolates a broken branch 18 while maintaining vacuum in the remaining unbroken branches. Under normal conditions in which there is no breach in the vacuum collection system 10, a vacuum level is maintained in the main vacuum pipe 16. The vacuum level is selectively transferred to each branch 18 (and, therefore, each collection line 20 associated with each respective branch 18) when an associated control valve 24 is open. In the event of a breach in one of the branches 18, the vacuum level in that branch and the main vacuum pipe 16 is immediately reduced. The vacuum loss due to the breach will also slightly lower vacuum level in the unbroken branches 18 if the associated control valves 24 are open, but the first valves 32 prevent any vacuum decrease from being significant. Because of the reduced vacuum level in the main vacuum pipe 16 and the relatively lower pressures present in the unbroken branches, the first valves 32 associated with the unbroken branches 18 will close, thereby substantially preserving vacuum level in those branches. The first valve 32 associated with the broken branch 18 does not experience a similar pressure differential, and therefore that valve will remain open.

The loss of pressure in the upstream portion 36 of the broken branch will trigger the associated shut-off valve 34 to close, thereby isolating the broken branch from the remainder of the system. Once the shut-off valve 34 is closed, the desired vacuum level in the main vacuum pipe 16 is reestablished, thereby reopening the first valves 32 associated with the unbroken branches and returning a majority of the system 10 to normal operation.

In addition to automatically isolating a broken branch 18, the valve network 12 of the present invention further facilitates location of a breach in the system 10. By operating as described above in response to a breach in the system, the branch 18 in which the breach is located is rendered inoperable while the remaining unbroken branches 18 continue to function properly. Accordingly, efforts spent to locate the breach may be immediately focused on the inoperable branch, thereby significantly reducing the amount of time needed to inspect the vacuum collection system 10.

In the event of vacuum loss not associated with a breach, the vacuum collection system 10 may automatically return to normal operation using the bypass ports 40. Such a vacuum loss may trigger the shut-off valves 34 to close, thereby isolating the branches 18 from the main vacuum pipe 16. The bypass ports 40, however, allow a small amount of vacuum to pass around each shut-off valve 34, thereby to slowly build vacuum pressure in the upstream portions 36 of the collection pipes 20. Once a sufficient vacuum level has been established in the upstream portions 36, the shut-off valves 34 will automatically open as described above, thereby returning the vacuum collection system 10 to normal operation. This process is similar to that for returning a broken branch 18 to normal operation after it has been fixed, as described above.

From the foregoing, it will be appreciated that the present invention brings to the art a new and improved automatic vacuum isolation valve network for use in a vacuum collection system. The valve network includes a first valve located in each branch adapted to close in response to vacuum loss in a main vacuum pipe, thereby preserving vacuum level in the associated branch. In addition, each branch includes a shut-off valve upstream of the first valve and adapted to close in response to vacuum loss upstream of the shut-off valve. When the shut-off valve closes, the associated branch is isolated from a remainder of the vacuum collection system, and the desired vacuum level may be reestablished in the main vacuum pipe. Once vacuum is regained in the main vacuum pipe, the first valves associated with the unbroken branches reopen, thereby returning those branches to normal operation. As a result, the valve network of the present invention allows a majority of the vacuum collection system to continue to operate in the event of a breach. In addition, by isolating the faulty branch, the valve network facilitates location of the breach.

What is claimed is:

1. An automatic vacuum isolation valve network for use in a vacuum collection system having at least two branches connected to a main vacuum pipe in fluid communication with a vacuum source, the network comprising:

a first valve located in each branch and adapted to close when air pressure in the main vacuum pipe is greater than air pressure in the branch; and a shut-off valve located in each branch upstream of the first valve, the shut-off valve adapted to close in response to vacuum loss in an upstream portion of a corresponding branch, thereby isolating the branch.

2. The vacuum isolation valve network of claim 1, in which each shut-off valve is a normally closed valve operable to an open position when the upstream portion of a corresponding branch is under negative pressure.

3. The vacuum isolation valve network of claim 2, in which each shut-off valve is vacuum operated, and has an operating port in fluid communication with the upstream portion of the corresponding branch.

4. The vacuum isolation valve network of claim 1, in which the shut-off valve is an electrically operated valve.

5. The vacuum isolation valve network of claim 4, in which the electrically operated shut-off valve is normally open, a pressure sensor is located in the upstream portion of a corresponding branch, and the shut-off valve is operatively connected to the pressure sensor to move to a closed position when the pressure sensor detects a pressure above a vacuum level.

6. The vacuum isolation network of claim 1, in which each branch further includes a bypass line connecting a portion of the branch upstream of the shut-off valve to a portion of the branch downstream of the shut-off valve.

7. The vacuum isolation network of claim 1, in which the first valve is a check valve.

8. A vacuum collection system for evacuating waste water, the system comprising:

a vacuum source adapted to generate a vacuum level;

a tank having a vacuum intake in fluid communication with the vacuum source and a waste water intake;

a main vacuum pipe connected to the waste water intake; and first and second branches, each branch including:

a first valve located in the collection pipe, the first valve adapted to close when air pressure in the main vacuum pipe is greater than air pressure in the branch; and a shut-off valve located in the branch upstream of the first valve, the shutoff valve adapted to close in response to vacuum loss in a downstream portion of the branch, thereby isolating the branch.

9. The vacuum collection system 8, in which each shut-off valve is a normally closed valve operable to an open position when the upstream portion of the branch is under negative pressure.

10. The vacuum collection system of claim 9, in which each shut-off valve is vacuum operated, and has an operating port in fluid communication with the upstream portion of the branch.

11. The vacuum collection system of claim 8, in which the shut-off valve is an electrically operated valve.

12. The vacuum collection system of claim 11, in which the electrically operated shut-off valve is normally open, a pressure sensor is located in the upstream portion of the branch, and the shut-off valve is operatively connected to the pressure sensor to move to a closed position when the pressure sensor detects a pressure above the vacuum level.

13. The vacuum collection system of claim 8, in which each branch further includes a bypass line connecting a portion of the collection pipe upstream of the shut-off valve to a portion of the collection pipe downstream of the shut-off valve.

14. The vacuum collection system of claim 8, in which the first valve is a check valve.

15. A method for maintaining vacuum in a vacuum collection system comprising at least two branches in fluid communication with a main vacuum pipe maintained under vacuum when one of the branches is faulty, each branch including a first valve and a shut-off valve located downstream of the first valve, the method comprising the steps of:

closing the first valve of each unbroken branch thereby to maintain vacuum therein;

closing the shut-off valve of a faulty branch thereby to isolate the faulty branch from the main vacuum pipe; and opening the first valve of each unbroken branch to reestablish fluid communication with the main vacuum pipe.

16. The method of claim 15, in which the step of closing the first valves is performed automatically when an air pressure level in the main vacuum pipe is higher than an air pressure level in the unbroken branches.

17. The method of claim 16, in which the first valve of each branch is a check valve.

18. The method of claim 15, in which the step of closing the shut-off valves is performed automatically when a vacuum level in a portion of the faulty branch upstream of the shut-off valve drops below a normal vacuum level.

19. The method of claim 18, in which the shut-off valves are normally closed, vacuum operated valves having an operating port in fluid communication with the upstream portion of the branch.

20. The method of claim 18, further comprising a pressure sensor disposed in the upstream portion of each branch, and in which the shut-off valves are normally open, electrically operated valves operatively connected to an associated pressure sensor, the electrically operated valves moving to a closed position in response to a sensed vacuum level below the normal vacuum level.

* * * * *